United States Patent [19]

Callahan et al.

[11] 4,135,024

[45] Jan. 16, 1979

[54] METHOD OF TREATING A LOW INTEGRITY DRY-FORMED NONWOVEN WEB AND PRODUCT MADE THEREFROM

[75] Inventors: Joseph W. Callahan, Drexel Hill; John G. Trumbull, Lima, both of Pa.

[73] Assignee: Scott Paper Company, Philadelphia, Pa.

[21] Appl. No.: 715,175

[22] Filed: Aug. 16, 1976

[51] Int. Cl.[2] ..... B32B 3/30; B32B 31/20

[52] U.S. Cl. ..... 428/171; 101/32; 156/166; 156/181; 156/209; 427/264; 427/275; 427/288; 428/198; 428/207; 162/117

[58] Field of Search ..... 162/146, 117; 427/264, 427/278, 275, 276, 277, 288; 428/173, 171, 198, 207, 211; 101/3 R, 23, 32, 170; 156/219, 720, 166, 180; 264/136, 137; 156/181, 291, 209, 62.6, 278; 118/211, 248

[56] References Cited

U.S. PATENT DOCUMENTS

| | | | |
|---|---|---|---|
| 2,128,516 | 8/1938 | Graham | 428/156 |
| 2,802,752 | 8/1957 | Wood, Jr. | 427/288 |
| 2,838,416 | 6/1958 | Babiarz et al. | 428/156 |
| 2,873,204 | 2/1959 | Hochuli et al. | 427/275 |
| 3,395,201 | 7/1968 | Kolwaites | 428/170 |
| 3,616,157 | 10/1971 | Smith | 428/171 |
| 3,684,641 | 8/1972 | Murphy | 428/207 |
| 3,850,095 | 11/1974 | Snyder | 101/32 |

FOREIGN PATENT DOCUMENTS

| | | | |
|---|---|---|---|
| 687783 | 6/1964 | Canada | 427/278 |

*Primary Examiner*—Stanley S. Silverman

*Attorney, Agent, or Firm*—Martin L. Faigus; William J. Foley

[57] ABSTRACT

Densified regions are formed in a low integrity dry-formed nonwoven fibrous web by embossing a front surface of the web with spaced-apart raised surfaces of an embossing roll. The web is embossed to the extent that the densified regions will transmit a treating fluid completely through their thickness to the front surface of the web while non-densified or high loft regions will not. Simultaneously with the embossing, treating fluid from a treating fluid conveying surface is applied to a rear surface of the web. The fluid migrates completely through the thickness of the web to the front surface in substantially only the densified regions of the web.

The product of this invention is a dry-formed web having a basis weight in the range of about 0.5 oz./yds.$^2$ to about 8.0 oz./yds.$^2$. A surface of the web has an undulate profile including high loft regions and valley regions. The density of the web in the high loft regions is less than about 0.10 gr./cc and the density in the valley regions is greater than the density of the web in the high loft regions. A treating fluid, which preferably is a coloring agent, penetrates completely through the thickness of the web only in the valley regions to cause a surface of the web to have a decorative pattern corresponding to the pattern of the valley regions in the web.

9 Claims, 3 Drawing Figures

METHOD OF TREATING A LOW INTEGRITY DRY-FORMED NONWOVEN WEB AND PRODUCT MADE THEREFROM

BACKGROUND OF THE INVENTION

1. Field of the Invention

This invention relates to a method of treating low-integrity dry-formed nonwoven fibrous webs, and more specifically to a method that decorates and enhances the structural integrity of such webs.

2. Description of the Prior Art

Dry-formed, nonwoven fibrous webs for replacing conventional textile fabrics are known in the prior art. Many of these webs are absorbent, strong, abrasion resistant, soft and flexible, i.e. conformable. Such webs can be employed as disposable towels, wipers, or pads, or used as substitutes for conventional textile fabrics in articles such as disposable diapers, sanitary napkins, and so forth.

The webs can be composed entirely of papermaking-length fibers (wood pulp, cotton linters, and other fibers having a length less than about ¼ inch (6.350 millimeters)), textile-length fibers (man-made and natural fibers having a length greater than about ¼ inch), or various combinations thereof. Wood pulp fibers are highly absorbent, readily available and more economical to use than textile-length fibers. Consequently, webs made entirely of wood pulp fibers or a preponderance thereof are becoming extremely popular, especially when such webs are intended for single or limited use applications.

Dry-formed, nonwoven webs can be made by an air-laid process, a carding process, or other methods that do not use a liquid to deposit the fibers in the web format. When such a web is initially formed it generally is not self-supporting, i.e. it has very low-structural integrity and mechanical strength. The low integrity and strength of the web results from the fact that the web, as initially formed, is held together primarily by cohesive forces provided by the limited frictional engagement and mechanical interlocking of fibers. In this condition the web has very limited applications, and therefore, for many end-use applications, it is necessary to posttreat the web to enhance its structural integrity and strength.

Methods of posttreating dry-formed, nonwoven fibrous webs have been suggested in the prior art. One such method is disclosed in copending U.S. patent application Ser. No. 569,232, filed Apr. 16, 1975, and assigned to Scott Paper Company. In accordance with that method water is applied to the initially formed web, and the wetted web is then sequentially conveyed through an embossing station, an adhesive application station and a drying and curing station to complete the formation of the nonwoven fabric.

The embossing treatment of the web compresses and densifies the web in the areas that are embossed, and the prior wetting of the web insures that the embossed pattern will be retained in said web. The densification of the web substantially increases the frictional engagement and mechanical interlocking among the fibers, and accordingly enhances the structural integrity and mechanical strength of the initially formed web. In addition, the densification operation produces densified regions in the web which generally have a capillary structure that is more favorable for transmitting liquids than the non-densified, or high loft regions.

Binders, such as acrylic latex, are applied to the embossed web at the adhesive application station to stabilize the fibers and add additional strength and structural integrity to the web. The web is then directed through the drying and curing station to complete the formation of the web. In this condition the web possesses substantial surface strength and structural integrity above that of a web which has only been embossed.

In treating a web it is often desirable to decorate the web by printing colors thereon in a selected pattern. One manner of decorating the web in such a selected pattern is to print a color on the embossed regions that is different from the color of the non-embossed regions. A web so decorated has the appearance of having been "valley printed", that is, printed with a different color in the valley or embossed regions that are recessed below the surface of the non-embossed regions.

Examples of prior art methods of printing completely formed and prepared webs in a selected pattern are disclosed in U.S. Pat. Nos. 1,716,237, issued to Molins; 2,128,516, issued to Graham; 2,168,229, issued to MacArthur; 2,667,426, issued to Davis; 2,674,974, issued to Gwinn et al.; and 2,984,342, issued to Smith. These methods are employed in connection with webs having a high degree of structural integrity, and are not at all concerned with handling and decorating low integrity dry-formed webs. Accordingly, there is no need in these prior art methods to provide for stablization of the web in conjunction with the decorating operation.

Prior art methods for imparting a "valley print" effect to a web are disclosed in the above-mentioned Graham and Davis patents, and also in U.S. Pat. No. 2,858,232, issued to Hushebeck, et al.

Graham is primarily directed to the handling and decorating of textile webs which have a high degree of structural integrity and strength as they are directed through the decorating operation. Accordingly, Graham is not at all concerned with providing a web handling and decorating system for use in connection with low integrity, dry-formed nonwoven webs to both stabilize, or strengthen the web, and decorate it.

Davis relates to mechanically working a web to provide raised areas and ground areas. Davis discloses an arrangement for decorating the web by either tip coating the raised areas or coating the ground areas. In accordance with both arrangements, a roll for transferring decorating fluid to the web is positioned downstream from a roll which mechanically works the web, and both of these rolls are backed by a smooth-surfaced roll 18. This is a somewhat complex arrangement which, when employed to coat the ground areas of the web, requires a somewhat complex gearing arrangement among the web-working roll, the web decorating roll and the backing roll to insure that proper registration of all three rolls is established. Moreover, Davis is not concerned with the problem of handling a low-integrity web to both increase its strength and decorate it. This lack of concern is evidenced by the fact that Davis includes web tensioning bars in the apparatus upstream of the treatment station. Employing such tensioning bars in the transfer of a low integrity dry-formed web to a decorating station would tend to destroy the structural integrity of the web.

Hushebeck et al. discloses a process for producing inlay effects in a fabric web. A non-flowing, thin layer of color paste is applied to the outer raised surfaces of a heated embossing roll. The layer of paste is transferred to the faces of the depressions that are formed when the fabric is embossed. The color pigment must be applied in paste form and it must have a viscosity such that it will remain upon the face of the depressions without running. The method of Hushebeck, et al. cannot be effectively used in treating low integrity dry-formed nonwoven fibrous webs because "fiber picking" will readily occur in such webs. Fiber picking refers to the pulling of fibers from the surface of the web that occurs when the disruptive stress in the treating fluid overcomes the cohesive forces which hold the fibers in the web. When treating fluid is applied to the raised surfaces of a decorating roll and these surfaces are employed to engage the valley regions of a low integrity web, fiber picking will readily occur. This tends to disrupt the integrity of the web's surface. If picking continues, fibers will build up on the raised surfaces and distort the image to be printed on the web as well as cause undesirable spots and depressions in the web. From the above discussion it can be seen that a need exist for a simple and reliable method for strengthening and treating low integrity webs. It is to such a method that the present invention is directed.

SUMMARY OF THE INVENTION

This invention relates to a novel method of treating a low integrity, dry-formed nonwoven fibrous web by simultaneously applying a treating fluid to the web and mechanically deforming the web to strengthen it. The method of this invention resides in forming densified regions in the low integrity web by embossing a front surface of the web with spaced-apart raised surfaces of an embossing roll. The embossing operation increases the frictional engagement and mechanical interlocking of fibers in the densified regions to enhance the overall structural integrity and strength of the web. The extent of embossing is such that the densified regions are provided with a capillary structure which will transmit a treating fluid completely through the thickness of the web to the front surface of the web when a quantity of the fluid is applied to the opposite, or rear surface of the web. Other areas of the embossed web have a lower density than the densified regions, and will hereinafter be referred to as "high-loft" regions. These high-loft regions have a capillary structure which does not transmit fluids completely through the thickness of the web to its front surface as readily as the densified regions of the web.

In accordance with this invention a quantity of treating fluid which will penetrate through the thickness of the web in the densified regions, but not in the high-loft regions, is applied to the rear surface of the web. This quantity of treating fluid is applied to the rear surface of the web simultaneously with the embossing operation by feeding the web through an embossing nip formed by the embossing roll and a treating fluid conveying surface. In the nip, the embossing roll presses the rear surface of the web against the treating fluid conveying surface. In this manner the embossing operation causes the treating fluid transferred to the rear surface of the web to completely penetrate through the thickness of the densified regions to the front surface of the web. However, no appreciable migration of the treating fluid through the thickness of the high-loft regions will take place, due to the capillary structure of the high-loft regions.

The method of this invention is particularly suitable for use in simultaneously strengthening a low integrity, dry-formed nonwoven web, and providing a valley print decorative effect on the front surface of the web. To provide the valley print effect on the web, a coloring agent, such as a dye or pigment, is included in the treating fluid that is conveyed to the embossing nip by the treating fluid conveying surface. In this manner the web is embossed to improve its structural integrity, and the coloring agent is caused to migrate completely through the thickness of the densified regions to the front surface of the web. However, the coloring agent will not migrate completely through the thickness of the web in the high-loft regions. This method provides a well-defined decorative pattern on the front surface of the web, i.e., the pattern almost precisely conforms to the configuration of the densified areas. The web treated in accordance with the method of this invention often has a two-sided appearance in which the rear surface is either uniformly colored, or has a pattern which is not as precisely defined as that created on the front surface.

If desired, the integrity of the web can be further enhanced by including an adhesive component along with the coloring agent in the treating fluid. In this manner the treatment of the web in accordance with this invention will provide additional strength due to the migration of the adhesive through the web in the densified regions. The spacing of the densified regions can be chosen so that the adhesive penetrating to the front surface of the web will be effective to tie down, or bond together, the fibers on the front surface of the web. Specifically, when the densified regions are distributed along the planar extent of the web at a spacing less than the average fiber length of the fibers in the web, the adhesive penetrating through the thickness of the web in the densified regions will bond the fibers on the front surface of the web together to enhance the strength and abrasion resistance of said front surface. For some uses of the web, additional strength and/or additional abrasion resistance may be desired, or required. For such uses additional adhesive can be applied to one or both surfaces of the web after the web has been treated in accordance with the broader aspects of this invention.

Most preferably, the treating fluid conveying surface employed in the method of this invention is a gravure printing roll having a highly polished metallic surface with a plurality of fluid retaining cells in its outer periphery. This surface is caused to rotate through a bath of treating fluid to pick up the fluid within its cells, and convey this fluid to the rear surface of the web at the embossing nip. The use of a highly polished surface of a gravure roll to convey the treating fluid into engagement with the web surface minimizes the tendency of the roll to pick fibers from said web surface. Moreover, any surface fibers which are picked from the web by the gravure roll are washed off of the roll as it is directed through the treating fluid bath. This prevents a buildup of fibers on the gravure roll and avoids the deleterious effects that such a buildup may cause. The treating fluid can be easily directed through a filtration and recirculation system to remove the fibers from the bath.

In accordance with this invention the raised surfaces of the embossing roll are not provided with the treating fluid to be conveyed to the web. This has the effect of minimizing the picking of fibers from the surface of the web that is engaged by the embossing roll because no fluid or fluid stress is present to readily pull fibers from the surface of the low integrity web.

If the initially formed web is already colored, a valley-print effect can be achieved in the web by including a bleaching agent in the treating fluid. It is also within the scope of this invention to include an adhesive component along with the bleaching agent to provide additional structural integrity to the web during the treatment operation.

The product of this invention is a dry-formed web having a basis weight in the range of from about 0.5 oz./yds.$^2$ to about 8.0 oz./yds.$^2$. At least one surface of the web has an undulate profile and includes high loft regions having a density less than about 0.10 gr./cc, and valley regions in the web having a density greater than the density of the web in the high loft regions. A treating fluid, which preferably is a coloring agent, penetrates completely through the web only in the valley regions. This causes a surface of the web to have a decorative pattern corresponding to the pattern of valley regions in the web. The web preferably includes over 50%, by weight, wood pulp fibers. More preferably, this web is comprised of from about 75–95%, by weight, papermaking-length fibers and from about 25–5%, by weight, textile-length fibers. The preferred basis weight range of the web is from about 0.5 ozs./yds$^2$ to about 6.0 ozs./yds.$^2$.

Other objects and advantages of this invention will become apparent by referring to the detailed description which follows, taken in conjunction with the drawings.

DESCRIPTION OF THE PREFERRED EMBODIMENTS

Figure 1:
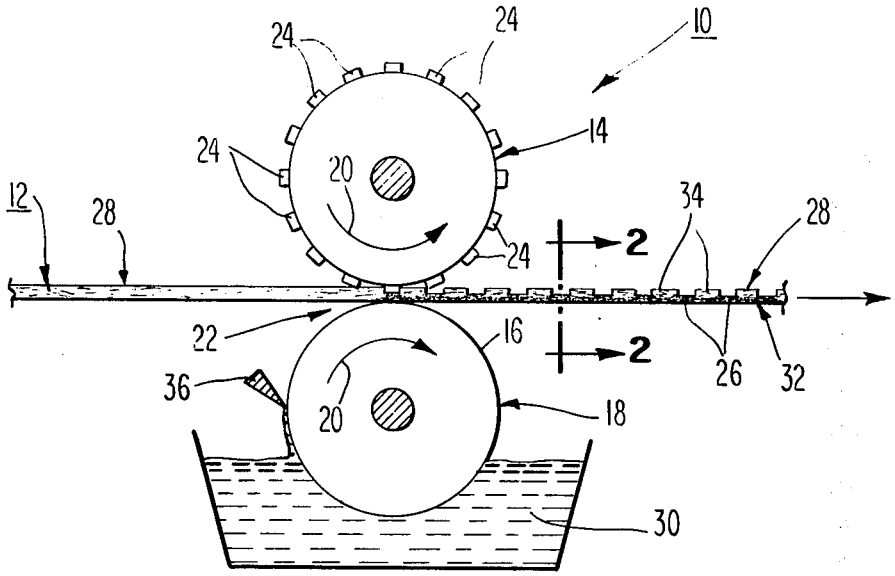
FIG. 1 is a side elevation view of an apparatus used in practicing the method of this invention.
Figure 2:
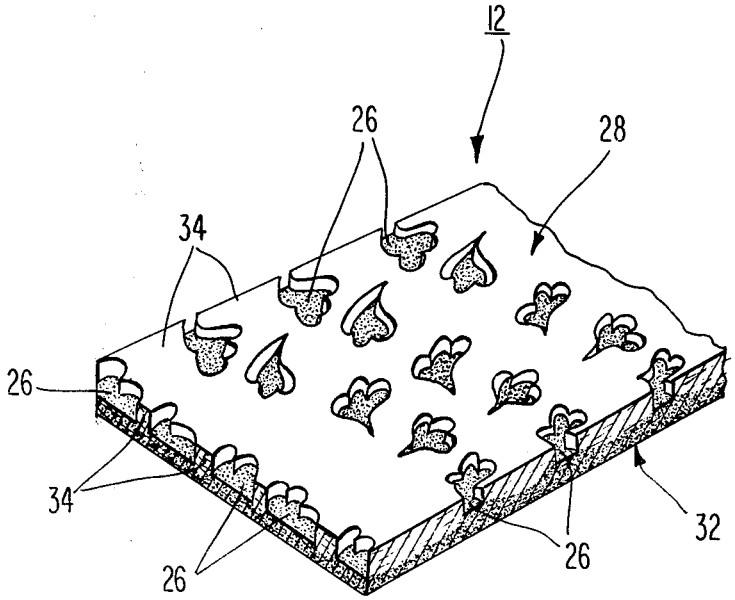
FIG. 2 is a fragmentary isometric view along line 2—2 of FIG. 1 of a web which is valley printed in accordance with the method of this invention.

Referring to FIG. 1, an apparatus 10 for treating a low integrity, dry-formed nonwoven fibrous web 12 according to the method of this invention is shown. Apparatus 10 includes an embossing roll 14, and a treating fluid conveying surface 16 which is provided by the peripheral surface of a gravure roll 18. The embossing roll 14 and gravure roll 18 are rotated in the direction shown by arrows 20 to form a treating nip 22 between the rolls. The embossing roll 14 includes raised-surfaces 24 that form densified regions 26 in the web 12 by engaging a front surface 28 of the web and pressing, or embossing the web against the conveying surface 16 when the web is directed through the treating nip 22. The web 12 is embossed to the extent that the densified regions 26 have a capillary structure which will transmit a treating fluid 30 completely through the thickness of web 12 to the front surface 28 thereof (FIG. 2).

Simultaneously with the embossing operation, the treating fluid 30 is transmitted from treating fluid conveying surface 16 to the rear surface 32 of the web 12. The fluid 30 migrates completely through the thickness of the densified regions 26 to the front surface 28 of web 12. The fluid 30 also migrates into the thickness of the non-densified, high loft regions 34. However, due to the capillary structure of the high loft regions 34 the fluid does not migrate completely through the thickness of said high loft regions.

Webs treated by the method of this invention are preferably air-laid webs. They can be comprised of papermaking-length fibers, textile-length fibers, or combinations thereof. A preferred web has from about 75–95% papermaking-length fibers and from about 25–5% textile length fibers. The preferred basis weight range of the webs treated in accordance with this invention is from about 0.5 ozs. per square yard to about 8.0 ozs. per square yard; with the most preferred range being from about 1.5 to 5.0 ozs. per square yard. Before embossing, the density of the web is generally less than about 0.05 grams per cubic centimeter and the web has an extremely low integrity construction. During the embossing operation, the high loft regions 34 may be partially compressed. However, it should be obvious that in all cases the density of the densified regions 26 is always greater than the density of the high loft regions 34. After embossing, the density of the densified regions 26 preferably ranges from about 0.08 to about 0.20 grams per cubic centimeter and the density of the high loft regions 34 is, preferably, less than 0.10 grams per cubic centimeter. It is to be understood that embossing parameters, such as pressure and temperature, may be varied depending upon such factors as the fiber composition and moisture level of the web. However, any web need only be embossed to the extent that the densified regions 26 will transmit the treating fluid 30 completely through their thickness to the front surface 28 of the web 12, while the high loft regions 34 will not transmit fluid 30 completely through their thickness to the front surface 28. The required extent of embossing for a particular fibrous web can be readily determined by one of ordinary skill in the art without any undue experimentation.

The treating fluid 30 can be a dye, pigment, binder, bleaching agent, or any compatible combination of substances capable of migrating completely through the densified regions 26 of the web 12 to the front surface 28 thereof.

In the most preferred embodiment of this invention, the treating fluid 30 includes a coloring agent such as dye or pigment, with or without a binder, to achieve a valley print decorative pattern in web 12. The coloring agent is included as a part of the treating fluid 30 and is applied therewith to the rear surface 32 of the web simultaneously with the embossing of said web. The quantity and characteristics of the treating fluid 30 are chosen so that the fluid will migrate completely through the thickness of the densified regions 26 to the front surface 28 of web 12 without migrating completely through the thickness of the web in the high loft regions 34. The particular quantity of treating fluid 30 which is employed will depend upon such factors as the viscosity of the treating fluid and the density and basis weight of the web 12. These factors can be determined empirically by one of ordinary skill in the art without an undue amount of experimentation. When a web is formed of previously colored fibers it can be valley printed by including a bleaching agent in the treating fluid 30.

The gravure roll 18 preferably includes fluid-receiving cells uniformly distributed about the entire peripheral surface thereof. The cells are preferably about 165 to about 185 microns on each side, about 30 microns in depth, and disposed in a concentration of about 100 cells per linear inch. When the low integrity web 12 is passed through the nip 22 between the embossing roll 14 and the gravure roll 18, it will be embossed to improve its structural integrity, and simultaneously the treating fluid 30 will be applied to the rear surface 32 of the web 12. The treating fluid 30 will then migrate completely through the thickness of the densified regions 26 to the front surface 28. However, the coloring agent will not migrate completely through the web thickness in the high loft regions 34. This method provides a well-defined decorative pattern on the front surface 28 of the web 12, i.e., the pattern almost precisely conforms to the configuration of the densified regions 26. However, the web 12 treated in accordance with this method often has a two-sided appearance in which the rear surface 32 is either uniformly colored, or has a pattern which is not as precisely defined as that created on the front surface 28. If it is desired to minimize the two-sided effect, the gravure roll 18 can include discrete groups of etched cells which are disposed in a pattern corresponding to the pattern of the raised surfaces 24 of the embossing roll 14. However, even in this embodiment, the fluid 30 applied to the rear surface 32 of the web 12 may tend to migrate, at least to some extent, in a lateral direction along the rear surface 32 to provide a somewhat two-sided effect. It should be recognized that when the gravure roll includes discrete groups of etched cells disposed in a pattern corresponding to the pattern of the raised areas 24 of the embossing roll 14, the movement of the embossing roll and gravure roll must be synchronized to insure that the raised areas 24 of the embossing roll will press the web 12 against areas of the gravure roll in which the groups of etched cells are located. This system with groups of etched cells in the gravure roll 18 is somewhat more complex than the system with etched cells uniformly distributed over the entire peripheral surface of the gravure roll.

In a preferred embodiment of this invention, the treating fluid conveying surface 16 is passed through a bath of the treating fluid 30 to permit the bath to wash away any fibers which may be pulled onto the conveying surface through fiber picking. As explained earlier, this prevents a buildup of fibers on the gravure roll and avoids the deleterious effects such a buildup may cause. A doctor blade 36 is used to remove excess treating fluid 30 from the conveying surface 16 as the surface emerges from the bath.

The embossing roll 14 and raised surfaces 24 thereon are, preferably, made of highly polished steel. Because no treating fluid 30 is applied to the embossing roll 14, no disruptive stress of the treating fluid is present to overcome the cohesive forces holding the fibers in the front surface 28 of web 12. Therefore, unlike some prior art embossing rolls which have a decorating fluid applied to their raised areas, fiber picking by the embossing roll 14 and raised surfaces 24 is insignificant and the clarity and definiteness of the embossing pattern is maintained.

The web 12 can be completely formed and prepared by including a binder, such as adhesive, in the treating fluid 30 and drying the treated web to set the binder. The adhesive migrates through the thickness of the densified regions 26 to their front surfaces and in so doing adds strength to the web. However, no adhesive is disposed in the front surfaces of the high loft regions 34. To further enhance the integrity of the web 12, the densified regions 26 can be distributed along the planar extent of the web at a spacing less than the average fiber length of the fibers in the web. With this spacing, the adhesive penetrating through the web 12 will effectively tie down or bond together the fibers in the front surface 28 of the web.

Figure 3:
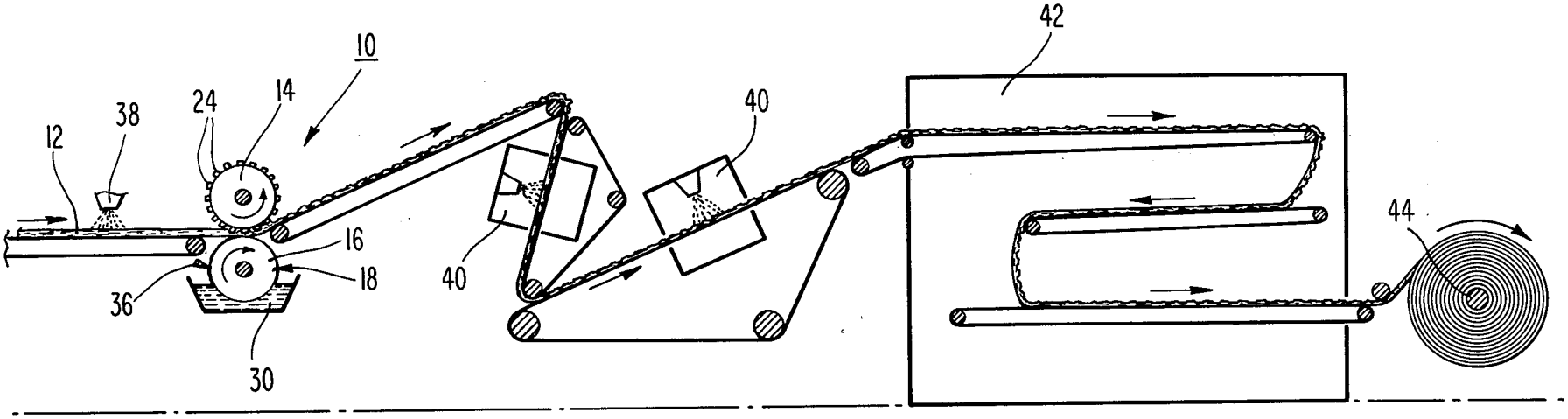
FIG. 3 is a side elevation view of the apparatus of FIG. 1 shown in position in a portion of a web-forming machine.

When the completely formed and prepared web 12 is intended for use as a wiper, especially a heavy duty wiper like those used in automotive garages, it is often desirable to apply additional adhesive to the web to increase the strength of the web, even though the treating fluid 30 may have included a binder. Referring to FIG. 3, a valley printed web 12 having substantial strength can be completely formed and prepared in accordance with the method of this invention by applying water to the initially formed low integrity web at spray station 38. The water is applied to the web to enhance its structural integrity and to aid in retaining the densified regions 26 in the web 12 after the embossing operation. However, it is not necessary to add water to the initially formed web in all cases. For example, no water need be added when the initially formed web 12 possesses sufficient moisture to enhance the integrity of the web and aid in retaining the densified regions 26 in the web.

After water has been applied, the web 12 is then treated according to the method of this invention by directing it into the nip 22 of treating apparatus 10. Apparatus 10 includes the treating fluid 30 which in turn includes a coloring agent, and may or may not include a binder. After the web emerges from the treating apparatus 10, a binder is applied to opposed surfaces 28 and 32 of the web 12 by spray stations 40. The web 12 with the binder thereon is then dried in oven 42. Preferably, web 12 is dried predominately from the front surface 28 to set the binder and facilitate the migration of the treating fluid (with coloring agent therein) completely through the thickness of web 12 in the densified regions 26. However, the drying step is not generally necessary to cause the treating fluid to migrate completely through the thickness of the densified regions 26 to the front surface 28 of the web. The drying oven 42 is preferably a transpiration type oven (as described in U.S. Pat. No. RE. 28,459, issued to Cole, et al.) which achieves drying by blowing a heated gaseous fluid through web 12 and then through a foraminous surface which supports the web while it is being transported through the oven. The subject matter of the Cole et al. patent is hereby incorporated by reference. The dried web is a completely formed and prepared web and may be wound onto a reel 44.

Although the preferred treating fluid conveying surface 16 has been described as the peripheral surface of a gravure roll 18, it is to be understood that other surfaces may be utilized which are capable of conveying the treating fluid to the embossing nip and acting as a backing surface to permit the initially formed web to be embossed. For example, the conveying surface can be the outer surface of a smooth surfaced cylindrical drum.

It is to be clearly noted that the methods of this invention are intended for use in the treatment of low integrity dry-formed nonwoven webs having a density generally less than 0.05 grams per cubic centimeter before embossing. In accordance with the treatment of such webs, the method of this invention simultaneously, and at a single station having a single nip, strengthens the web by embossing it and treats the web with a treating fluid.

This invention also includes the webs formed in accordance with the method disclosed and claimed herein. Referring to FIG. 2, the preferred product of this invention comprises a dry-formed fibrous web 12 having a basis weight in the range of from about 0.5 oz./yds.$^2$ to about 8.0 ozs./yds.$^2$. The front surface 28 of the web 12 has an undulate profile which includes high loft regions 34 and valley, or densified regions 26. The density of the web 12 in the high loft regions 34 is less than about 0.10 grs./cc and the density of the web in the densified regions 26 is greater than the density of the web in the high loft regions 34. A coloring agent penetrates completely through the web 12 to the front surface 28 thereof only in the valley regions 26.

The density of a particular region of the web 12 is determined as follows. First, a sample of the region in question is taken and the basis weight (weight of fibers per unit area) is determined for the sample. Next, a photomicrograph of an edge region of the sample is taken and the thickness of the sample is determined from the photomicrograph. The thickness is then divided into the basis weight to give the weight per unit volume of the sample, or the density.

The web 12 can be comprised of papermaking-length fibers, textile-length fibers, or combinations thereof. Preferably, web 12 has from about 75–95%, by weight, papermaking-length fibers and from about 25–5%, by weight, textile-length fibers.

Having described my invention, I claim:

1. A method of simultaneously strengthening and decorating a low integrity dry-formed nonwoven fibrous web, said method comprising the steps of:

a. forming spaced-apart densified regions in the web to strengthen the web by embossing a front surface of the web with spaced-apart raised surfaces of an embossing roll, the densified regions being able to transmit a treating fluid completely through the thickness of the web from a rear surface of the web to the front surface thereof, and simultaneous with the embossing;

b. applying a treating fluid that includes a coloring agent to the rear surface of the web from a treating fluid conveying surface that is free of raised, spaced-apart web embossing areas for causing the fluid to be transmitted completely through the thickness of the web from the rear surface to the front surface thereof in substantially only the densified regions to thereby impart a valley print decorative effect in the front surface, the treating fluid conveying surface being disposed opposite the raised surfaces on the embossing roll and constituting a backing surface for the web during the step of forming the densified regions in said web.

2. The method according to claim 1, wherein the treating fluid includes a binder.

3. The dry-formed fibrous web made according to the method of claim 1.

4. The method according to claim 1, wherein the treating fluid conveying surface comprises the peripheral surface of a gravure roll, the gravure roll surface having a uniform distribution of fluid receiving cells therein for applying the treating fluid substantially uniformly over the rear surface of the web.

5. The dry-formed fibrous web made according to the method of claim 4.

6. The method according to claim 1, wherein the treating fluid includes a binder and the densified regions are distributed along the planar extent of the web and spaced-apart less than the average fiber length of the fibers forming the web so that fibers in the front surface of the web are bonded together to enhance the strength and abrasion resistance of the front surface.

7. The dry-formed fibrous web made according to the method of claim 6.

8. The method according to claim 1, wherein the treating fluid conveying surface comprises the peripheral surface of a gravure roll, the gravure roll surface including closely spaced fluid-receiving cells arranged in a pattern corresponding to a pattern of raised surfaces on the embossing roll.

9. The method according to claim 8, wherein the treating fluid includes a binder.

* * * * *